United States Patent [19]

Sakashita et al.

[11] 4,222,506

[45] Sep. 16, 1980

[54] MOLTEN STEEL OUTFLOW AUTOMATICALLY CONTROLLING DEVICE

[75] Inventors: Tsutomu Sakashita; Isao Yamazaki, both of Ibaragi, Japan

[73] Assignee: Sumitomo Metal Industries Limited, Osaka, Japan

[21] Appl. No.: 851,773

[22] Filed: Nov. 15, 1977

[30] Foreign Application Priority Data

Nov. 17, 1976 [JP] Japan ..... 51-138692

[51] Int. Cl.[2] ..... B22D 41/08

[52] U.S. Cl. ..... 222/600; 164/155; 222/52

[58] Field of Search ..... 222/1, 590, 597–602, 222/52, 63, 504, 600; 164/4, 155

[56] References Cited

U.S. PATENT DOCUMENTS 3,537,505 11/1970 Thalmann ..... 164/4

4,077,457 3/1978 Hashio et al. ..... 222/600 X

FOREIGN PATENT DOCUMENTS 2637421 7/1977 Fed. Rep. of Germany ..... 164/155

*Primary Examiner*—David A. Scherbel

*Attorney, Agent, or Firm*—Watson, Cole, Grindle & Watson

[57] ABSTRACT

A molten steel outflow automatically controlling device comprising an infrared ray camera for detecting infrared rays emitted by a molten steel stream and slag flowing down out of a molten steel vessel such as a ladle or converter, a color monitor for converting the infrared rays emitted by the molten steel and slag into video signals with such infrared ray camera and for developing monitor picture images by color-printing the signals in two kinds, a signal discriminating device for making the two kinds of color picture images discriminating signals by the ratio of areas and a nozzle closing device for closing a nozzle for the outflow of molten steel of the molten steel vessel by such discriminating signal as is mentioned above, whereby, when the remaining amount of the molten steel in the molten steel vessel becomes small, the outflow of the slag will be detected and the nozzle for the outflow of the molten steel will be automatically closed to stop the pouring and to prevent the slag from mixing into the molten steel.

5 Claims, 4 Drawing Figures

MOLTEN STEEL OUTFLOW AUTOMATICALLY CONTROLLING DEVICE

BACKGROUND OF THE INVENTION

1. Field of the Invention

This invention relates to a device for automatically controlling the flow of molten steel out of a molten steel vessel to minimize the outflow of slag into molten steel by stopping the pouring by detecting the time(pouring end period) when the remaining amount of the molten steel flowing down out of such molten steel vessel as a converter or ladle becomes small.

2. Description of the Prior Art

The end of the pouring in of molten steel flowing down out of such molten steel vessel as a converter or ladle has been conventionally known by detecting the outflow of slag by observation of a molten steel stream. However, with such sight observation, it is so difficult to distinguish molten steel and slag from each other that there have been defects that, the slag is mixed into the molten steel to increase nonmetallic inclusions and to reduce the quality and particularly, at the time of a continuous casting, the generation of breakouts is induced.

SUMMARY OF THE INVENTION

In order to eliminate the defects of the conventional sight observation, to reduce nonmetallic inclusions in molten steel and to stabilize the operation, the present inventors have invented a technique of detecting the outflow of slag by photographing a molten steel stream as an infrared picture image and utilizing the difference between the infrared ray sensitivities of molten steel and slag by noting that the infrared ray emissivities of molten steel and slag are different from each other.

Therefore, an object of the present invention is to provide an automatic controlling device for closing a molten steel outflow nozzle by a control signal based on the detection of the outflow of slag.

DETAILED DESCRIPTION OF PREFERRED EMBODIMENTS

Figure 2:
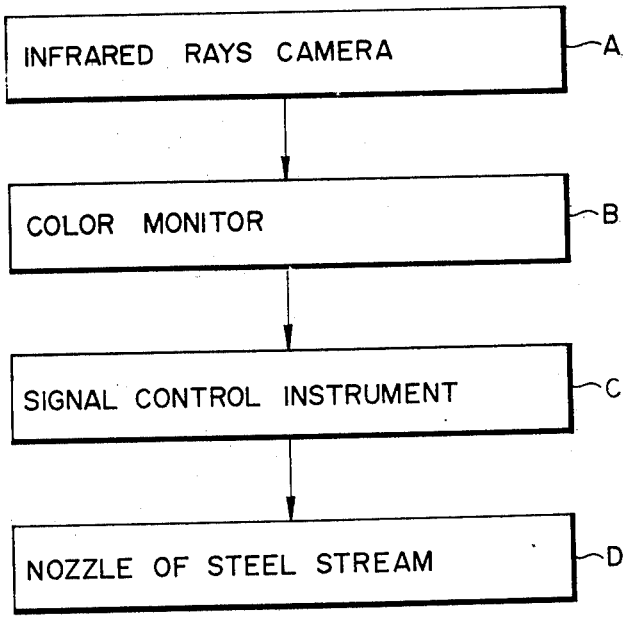
FIG. 2 is a block diagram of a device according to the present invention.

An embodiment of the device of the present invention as applied to a continuous casting equipment is shown in FIG. 2. It consists of a combination of an infrared ray camera A, a color monitor B, a signal discriminating device C and a molten steel outflow closing device D.

Figure 1:
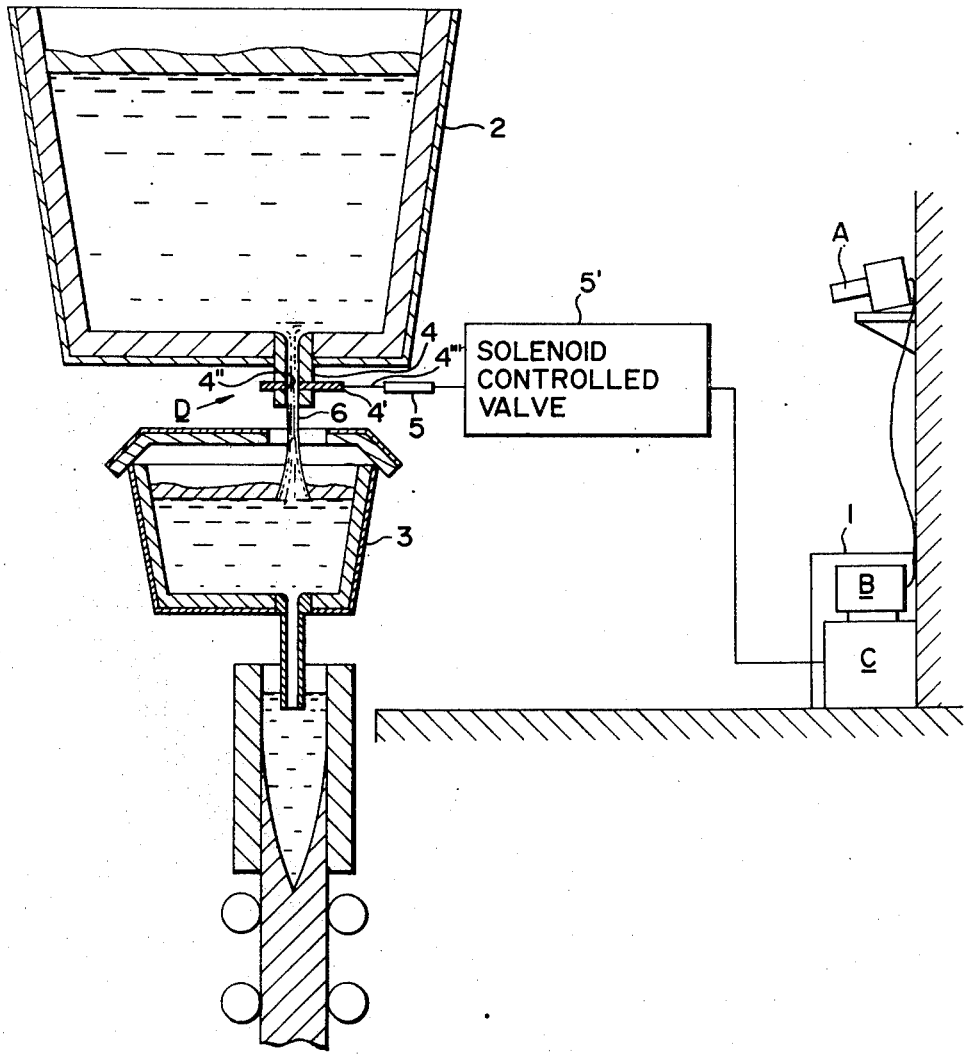
FIG. 1 is a explanatory view showing an essential part when the present invention is embodied in a continuous casting equipment.

As shown in FIG. 1, the infrared ray camera A for converting invisible infrared emission rays coming out of an object to video signals and amplifying them is set at a point distant by more than about 2 meters from the continuous casting equipment so as to photograph a molten steel stream 6 between a ladle 2 and a tundish 3. The color monitor B and signal discriminating device C are contained in a control box 1. The infrared ray camera A and color monitor B are connected with each other through a wiring.

The molten steel outflow closing device D consists of a combination, for example, of a sliding nozzle 4 and a hydraulic cylinder 5. This is to say, the sliding nozzle 4 is provided with a sliding opening and closing plate 4' having a hole 4''. The above mentioned sliding opening and closing plate 4' is connected to the tip of a piston rod 4''' of the hydraulic cylinder 5 and a solenoid controlled valve 5' attached to the hydraulic cylinder 5 is wired to the output side of the signal discriminating device so as to operate the hydraulic cylinder 5 by opening and closing the solenoid controlled valve with a signal from the above mentioned signal discriminating device C.

Figure 3:
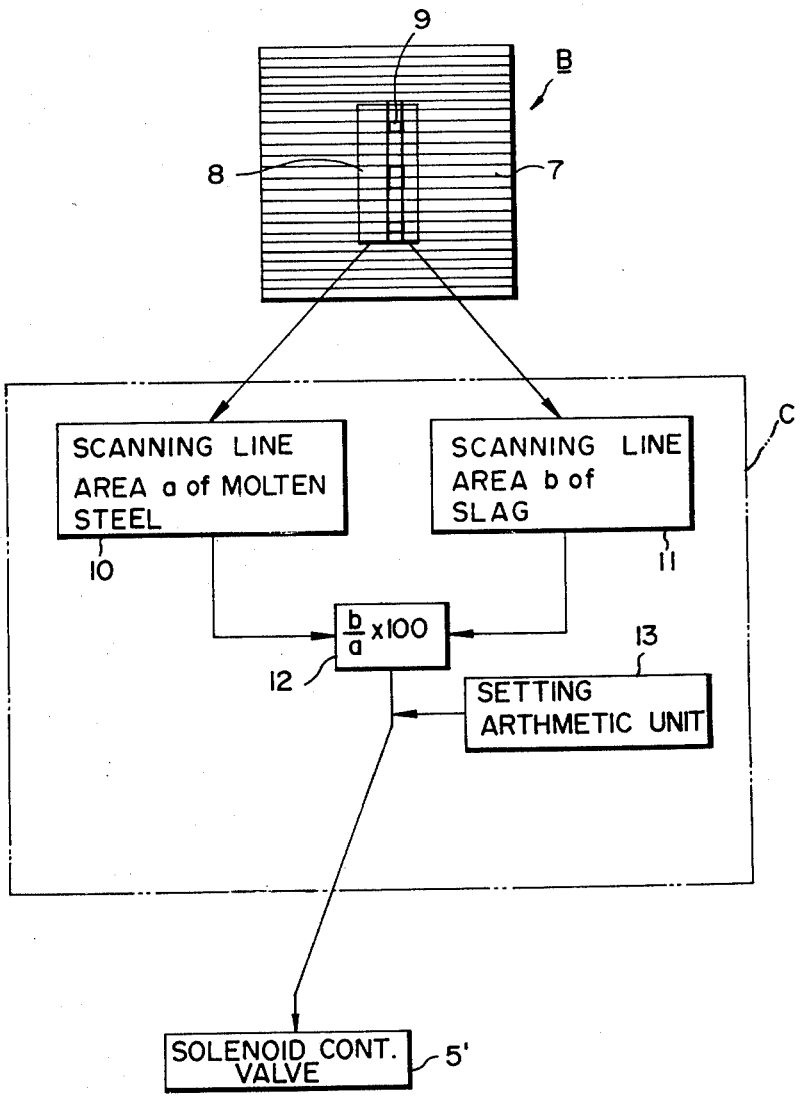
FIG. 3 is a block diagram of a color monitor and signal discriminating device.

As shown in FIG. 3, the color monitor B is so formed as to convert the wave length of the video signal sent from the infrared ray camera A to various colors so that the molten steel stream between the ladle 2 and tundish 3 may be shown by scanning lines 8 in the middle of all the scanning lines 7 of the color monitor. If slag flows down into the molten steel stream flowing down out of the ladle 2, the slag will appear in the scanning lines 8 of the molten steel stream due to the scanning lines 9. That is to say, the infrared ray emissivity of the slag is so much higher than that ($\epsilon \approx 0.28$) of the molten steel that, if the slag mixes in, high luminosity speck 9 will appear in the scanning lines 8.

For example, as picture image indicating contents, a molten steel stream(red) from the ladle 2 of about $20 \times 40$ mm (the size of the picture image varies with the distance between the infrared ray camera A and the molten steel flowing down out of the ladle 2) and a slag(yellow) in the molten steel of about 3 to $5 \times 3$ to 5 mm are shown as picture images on a picture surface of about $150 \times 150$ mm.

The signal discriminating device C is to determine the ratio of the area of the(yellow) scanning lines of the slag to the area of the(red) scanning lines of the molten steel stream shown by the above mentioned color monitor B, compare this ratio of areas with a predetermined set value and issue a control signal when it is larger than the set value. An example is shown in FIG. 3.

That is to say, computers or detecting means 10 and 11 in which the (red) scanning lines 8 of the molten steel stream shown by the color monitor B are represented by an area a and the (yellow) scanning lines of the slag are represented as an area b, and a computer or comparator 12 in which the area ratio $b/a \times 100$ is determined are provided so that the scanning line area ratio computed here is compared with the ratio set value set in advance in a ratio setter 13 and when it is larger than the set value, a control signal for closing the nozzle will be issued.

It should be pointed out that computers 10, 11 and ratio setter 13 are known devices which function for the purposes and in the manner as herein described. For example, computers 10, 11 and 12 may be microcomputers of Type 900 TX manufactured by Hokushin Electric Works Co., Ltd., and ratio setter 13 may be a VSI ratio bias setter manufactured by Yamatake-Haneywell Instrument Co., Ltd.

According to the automatic controlling device of the present invention, if the infrared ray camera A is directed to the molten steel stream flowing down from the ladle 2 to the tundish 3 during a continuous casting and the state is shown by the color monitor B, as soon as the slag mixes in and flows down, the scanning line area ratio of the molten steel and slag will be computed and will be compared with the set value set in advance to prevent the outflow of the slag in the pouring end period and, when it is larger, a control signal will be immediately issued and the molten steel outflow closing device will be automatically operated to close the molten steel outflow nozzle of the ladle. Therefore, nonmetallic inclusions mixed into steel will be remarkably decreased.

Figure 4:
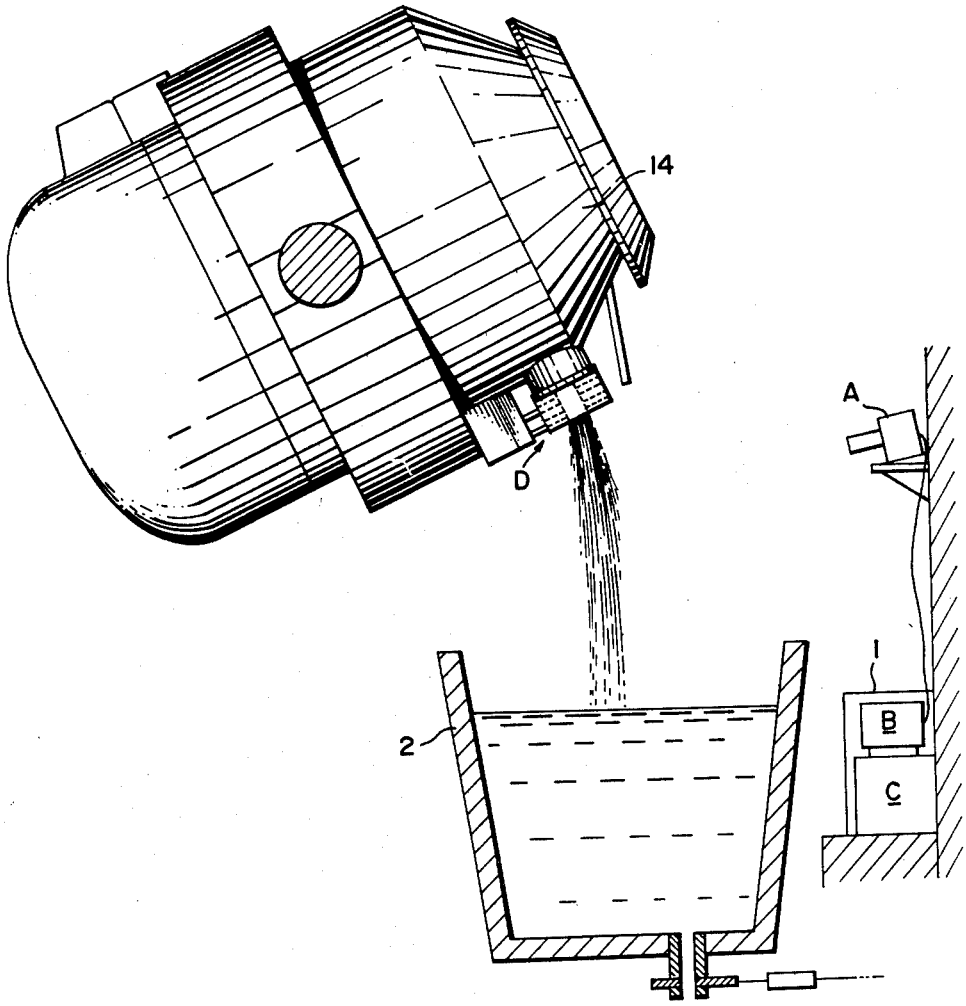
FIG. 4 is an explanatory view showing an essential part in case the present is embodied in a converter.

The present invention has been explained with reference to the embodiment in the continuous casting equipment as described above. However, it is also possible to use it in the work of a converter 14 into the ladle 2 as in FIG. 4.

An example of the present invention shall be explained in the following.

EXAMPLE

In case an aluminum killed steel consisting of 0.05% carbon, 0.21% manganese, 0.02% silicon, 0.014% phosphorus, 0.01% sulfur and 0.064% soluble aluminum, the rest being iron, was molten in a converter and a slab of a thickness of 270 mm. and width of 1800 mm. was made at a casting speed of 1.00 m/min by continuous casting of ladle molten steel outflow automatically controlling device embodying the present invention was used.

A molten steel at 1565° C. received in a ladle of a capacity of 250 tons was poured in at 4.52 tons/min by using a sliding nozzle. At the time (pouring end period) when the remaining amount of the molten steel in the ladle became small, the scanning line area ratio of the slag was set in advance to be any (for example, 12%) by said device and the result was incorporated into the sliding nozzle automatically closing circuit to stop the outflow of the molten steel and slag.

When the nonmetallic inclusions in the obtained slab were analyzed, it was confirmed that they had remarkably decreased as compared with a conventional slab made by stopping the outflow by sight.

The above mentioned molten steel was sampled in the pouring end period and the inclusions in the steel were compared to obtain the following results.

| | Inclusions in the molten steel in the tundish (per 10kg. of molten steel) | Inclusions in the product (per 10kg of slab) |
|---|---|---|
| Detecting method of slag flow by sight (conventional method) | 150 to 200mg | 3 to 5mg |
| Detecting method of slag outflow by the present invention | 10 to 20mg | 0.5mg |

We claim:

1. A device for controlling molten steel flowing out of a molten steel vessel through a nozzle provided thereon, comprising an infrared ray camera emitting a video signal for detecting infrared rays emitted by a stream of the molten steel and slag flowing out of the nozzle, control means operatively connected with the camera and including a color monitor for converting the wave length of the video signal sent from the camera into two different colors respectively for the molten steel and slag and for showing them in monitor picture images as scanning lines, the control means further including a signal discriminating means for making the two different picture images as discriminating signals by an area ratio thereof, and nozzle closing means operatively connected to the signal discriminating means and to the nozzle for closing the flow of the molten steel out of the vessel by closing the nozzle as determined by the discriminating means based on a predetermined value of the area ratio, whereby the nozzle is closed in response to the presence of slag in the flow from the nozzle.

2. The device according to claim 1 wherein said molten steel vessel comprises a ladle.

3. The device according to claim 1 wherein said molten steel vessel comprises a converter.

4. The device according to claim 1, wherein the signal discriminating means includes, means for detecting as areas two types of scanning lines of the molten steel and slag imaged in the monitor picture images, a comparator for comparing the detected areas and converting them into a ratio of areas, a ratio setter for comparing the ratio of areas with a predetermined set ratio and for discriminating the size of the ratio of areas as compared with the set ratio, and means for issuing a control signal to the nozzle closing means when the ratio of areas is larger than the set ratio for closing the nozzle.

5. The device according to claim 1, wherein the nozzle closing means includes the nozzle having an outlet opening, a movable plate having a hole therein for movement out of alignment with the opening for closing the nozzle, a hydraulic cylinder for moving the plate and a solenoid controlled valve operated by a signal from the signal discriminating means for operating the cylinder.

* * * * *